US005715879A

United States Patent [19]

Jones

[11] Patent Number: 5,715,879

[45] Date of Patent: Feb. 10, 1998

[54] NOSE BAR AND DRIVE ASSEMBLY

[76] Inventor: William F. Jones, 27569 Erickson Rd., Eugene, Oreg. 97402

[21] Appl. No.: 679,585

[22] Filed: Jul. 15, 1996

[51] Int. Cl.[6] ..... B27L 5/02

[52] U.S. Cl. ..... 144/213; 144/209.1

[58] Field of Search ..... 144/209.1, 211, 144/213, 215, 365

[56] References Cited

U.S. PATENT DOCUMENTS

| | | | |
|---|---|---|---|
| 3,480,053 | 11/1969 | Whipple | 144/460 |
| 4,494,589 | 1/1985 | Kajikawa et al. | 144/213 |
| 4,494,590 | 1/1985 | Kajikawa et al. | 144/213 |
| 4,602,663 | 7/1986 | Browning et al. | 144/213 |
| 4,632,161 | 12/1986 | Kajikawa et al. | 144/213 |
| 4,708,180 | 11/1987 | Browning, Jr. et al. | 144/213 |

*Primary Examiner*—W. Donald Bray
*Attorney, Agent, or Firm*—James D. Givnan, Jr.

[57] ABSTRACT

A veneer lathe is disclosed having a nose bar and drive assembly in place thereon. A nose bar shaft is splined lengthwise and supported by lathe mounted bearing assemblies. Rolls include splined inserts for shaft engagement. Roll surfaces are grooved for biased engagement with a wooden article installed in the lathe. Drive members are insertably engaged with ends of the nose bar shaft and with power transmission units in place on the veneer lathe. The drive members are disengaged from the nose bar shaft upon positioning of retainer caps on each power transmission unit.

7 Claims, 3 Drawing Sheets

NOSE BAR AND DRIVE ASSEMBLY

BACKGROUND OF THE INVENTION

The present invention pertains generally to nose bars as used in veneer lathes.

In the cutting or peeling of veneer sheets from a log or block of wood it is common practice to forcefully engage a roll or rolls with the periphery of the block being peeled immediately in advance of blade contact with the block. Substantial forces are imparted to the block by a nose bar to power the block, along with the lathe chuck, and to compress the block periphery to enhance the quality of the sheet cut. Accordingly nose bars are subjected to loads and rotational speeds which result in high maintenance efforts to ensure optimum veneer quality. The veneer sheets are of a very thin nature commonly for use as plywood laminates where it is desirable that dimentional variances in sheet thickness be held to plus or minus 0.003 of an inch. Nose bar assembly wear contributes to not meeting such tolerances.

Frequent servicing of nose bars entails bar removal from the lathe, refurbishing of bearings and other bar components and reinstallation. Normally several man hours are expended in the replacement and/or refurbishing of a nose bar. Removal and subsequent reinstallation of a nose bar assembly are hampered by existing coupling arrangements between drive components and the bar ends. Such is particularly costly when shut down during a work shift. The use of keys and key-ways hinders refurbishment of known nose bar assemblies by slowing disassembly of same.

U.S. Pat. No. 4,602,663 discloses a veneer lathe with a powered nose bar of tubular, grooved construction supported at intervals by open bearings in place along a lathe pressure bar. The nose bar ends are in keyed engagement with connector sleeves which engage flexible members which permit lateral shifting of the nose bar axis during operation. Each end of the nose bar is driven by a power transmission unit having an output drive shaft integral with a connector member at the base end engageable with a flexible member. No provision is made for axial disengagement of the transmission output drive shaft for nose bar servicing. The nose bar relies on the bearing assemblies spaced therealong to support the bar against laterally imparted loads with the flexible member accommodating displacement of the bar axis. No provision is seen to permit convenient disconnection of the nose bar from the power transmission untis.

U.S. Pat. No. 3,480,053 discloses a small diameter, solid nose bar having a sleeve coupling at one end held in place by a set screw with the sleeve having a squared socket for somewhat loose reception of a squared end of a transmission drive shaft to accommodate flexing of a strongback 224 away from shaft 256. A ball element at 320 serves to carry thrust loads on shaft 254.

U.S. Pat. No. 4,494,590 discloses a series of circular disks which serve to propel and direct veneer onto a guide 13 immediately subsequent to being cut or sliced. Bars 23 serve to impart pressure to the log or block peripheral surface. The spaced apart circular disks 11 are carried by a shaft 27 which is of a splined nature but again does not constitute part of a nose bar as that function is served by fixed pressure bars 23 of the patented structure. Similar structure is shown in U.S. Pat. Nos. 4,494,589 and 4,632,161.

SUMMARY OF THE PRESENT INVENTION

The present invention is embodied in a roller nose bar and drive assembly utilizing splined components contributing both to bar life and speed of refurbishment.

The present roller bar assembly includes a series of rolls, each having a grooved or fluted surface, with the flutes of one roll preferably in alignment with other roll flutes to effect desired engagement with a log or block. Substantial uniform pressure is applied jointly by the several roll elements while avoiding imparting of large thrust loads to the nose bar. The roll elements have internal, splined members in engagement with the nose bar shaft to ensure precise rotational positioning of the roll elements on a nose bar shaft with regard to roll flute alignment. Axial loading of the nose bar assembly and resultant wear is thereby minimized.

At the ends of the nose bar shaft are connectors each splined to receive a drive member powered by a transmission unit adjacent the ends of the nose bar shaft. The power transmission units are of a design permitting disengagement of the drive members from the nose bar shaft during periodic servicing of the nose bar assembly. Conversely, the drive members are retained in roller bar engagement by psoitionable retainers which preferably include means for adjsuting end play of the nose bar shaft.

Nose bar rigidity is greatly benefitted by the incorporation of splined components therealong including bearing members. Uniform compression of the block or log surface by the rigid bar enables sheet thickness to be held to close tolerances. Upon displacement of the nose bar from the lathe the bearing assemblies are readily slid off the bar shaft, replaced or serviced and reinstalled on the nose bar shaft along with the rolls. To ensure the flutes or grooves of the rolls being in alignment the nose bar rolls are machined to form such grooves while in place on the splined nose bar shaft.

Important objectives of the nose bar assembly include the provision of a nose bar and drive assembly for a veneer lathe and having a splined shaft on which a series of rolls are carried with the rolls equipped with pairs of internally splined sleeves or inserts with each of the sleeves located adjacent an inner bearing race also of splined construction to provide a very rigid nose bar; the provision of a nose bar assembly readily serviceable upon disengagement of the nose bar shaft from retractible drive members located adjacent the shaft ends; the provision of connectors adjacent the ends of the nose bar assembly into which drive members are insertable; the provision of nose bar drive members which may be extracted from nose bar shaft engagement with axial displacement of the members permitted by removal of retainers carried by power transmission units; the provision of a nose bar assembly achieving a substantial reduction in nose bar maintenance effort and which lends itself to use in retrofitting of existing veneer lathes.

DETAILED DESCRIPTION OF THE PREFERRED EMBODIMENTS

Figure 1:
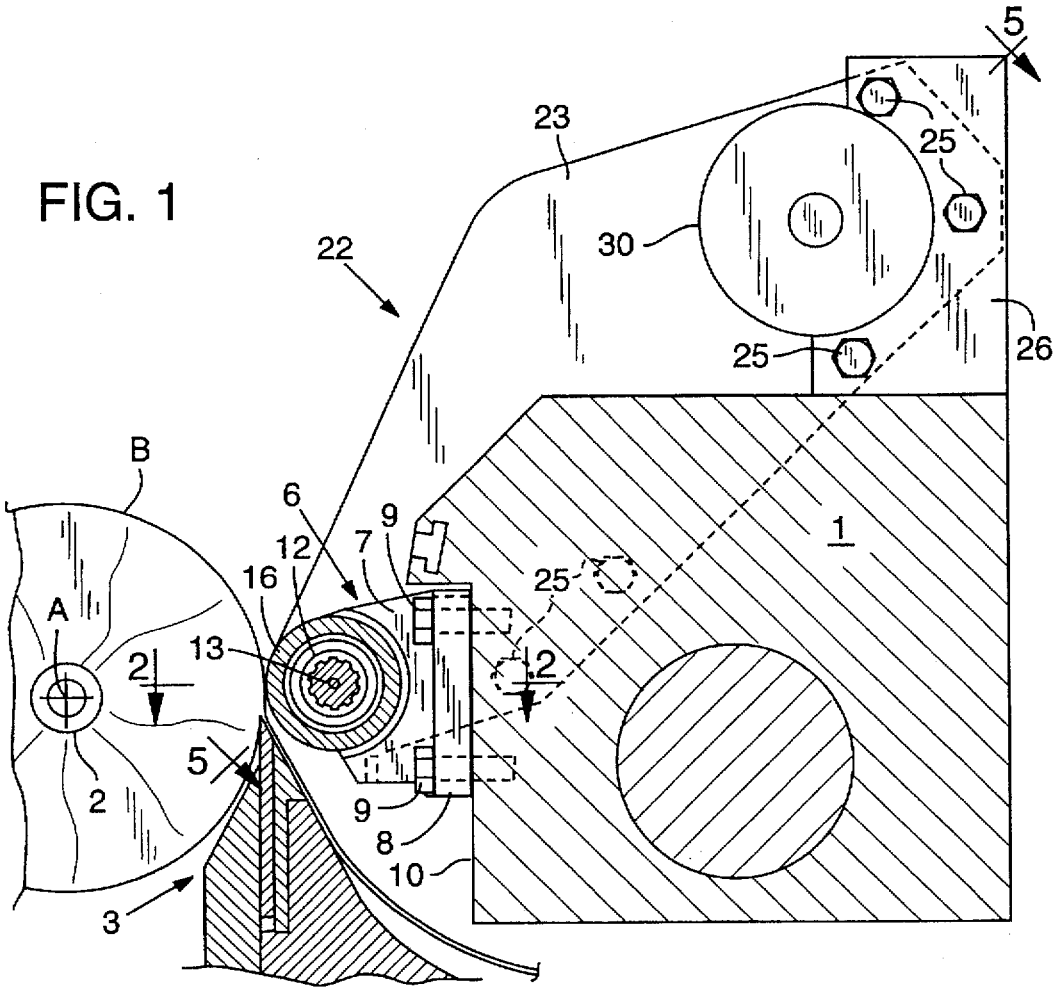
FIG. 1 is a vertical sectional view of a lathe pressure bar and knife assembly of a wood veneer lathe with the present nose bar assembly in place on the pressure bar.
Figure 2:
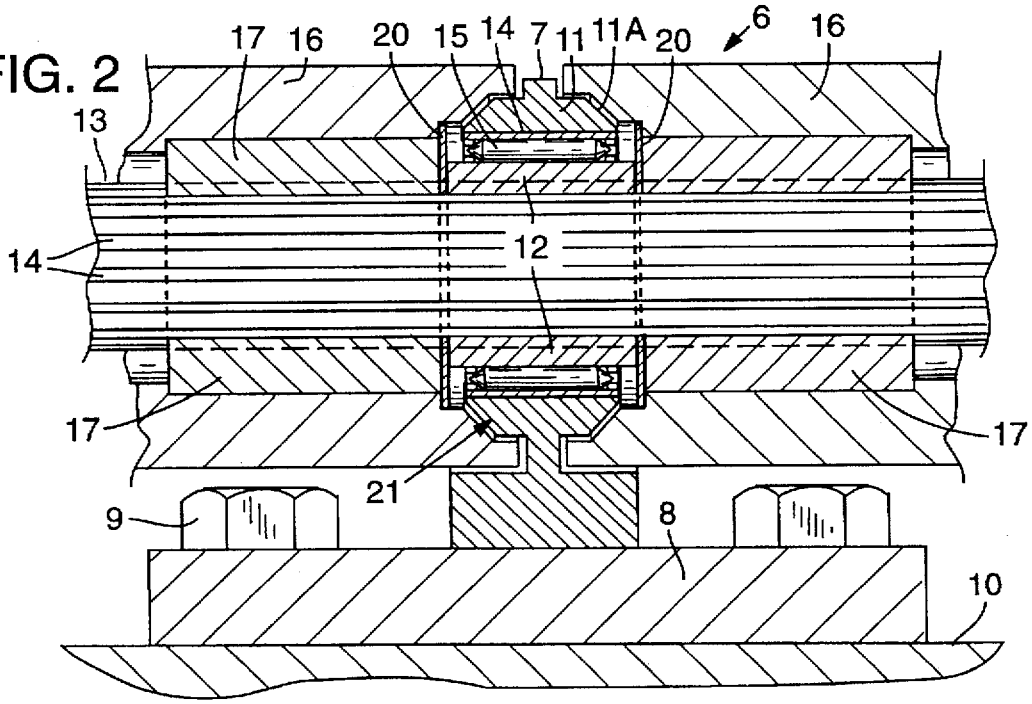
FIG. 2 is a horizontal sectional view taken along line 2—2 of FIG. 1.

With continuing attention to the drawings, the reference numeral 1 indicates a pressure bar of a wood veneer lathe which extends in parallel with the axis A of a block or log B carried by chucks as at 2 of the veneer lathe. A knife assembly is generally indicated at 3 with a knife at 4. Both the pressure bar and the knife assembly are advanced toward block B by powered lathe components during the peeling of block B. Lathe construction and operation are well known in the wood products industry and further elaboration is believed unnecessary for understanding of the present invention. Reference may be had to U.S. Pat. No. 4,602,663 for a general description of lathe construction and operation common to veneer lathes in use.

With attention now to the portion of the present invention shown installed on the lathe pressure bar 1, a nose bar assembly generally at 6 is carried by bearing assemblies 7 which are spaced along surface 10 and project forwardly from pressure bar 1 for heavily biased contact with the peripheral surface of block B.

Each bearing assembly includes a base or pad 8 for bolted securement at 9 to a forward face 10 of the pressure bar. A bearing housing 11 is beveled at 11A and carries an outer bearing race at 14 for roller bearings at 15. An inner race 12 has internal splines which receive a splined nose bar shaft 13 having lengthwise splines 14 received by splined inner race 12. Threaded end segments of the shaft are at 13A.

Figure 3:
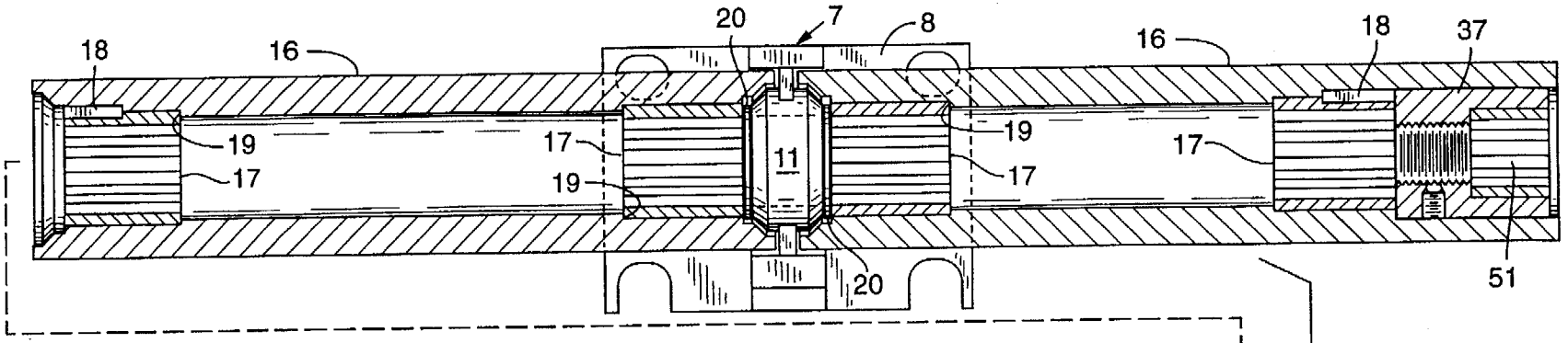
FIG. 3 is a segmented sectional view of the present nose bar assembly with roll segments and bearing members removed for purposes of illustration.
Figure 3:
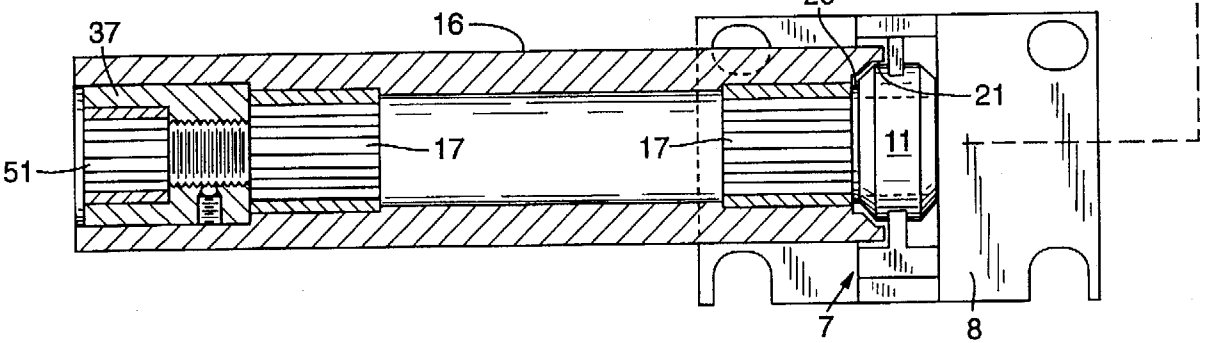
Figure 4:
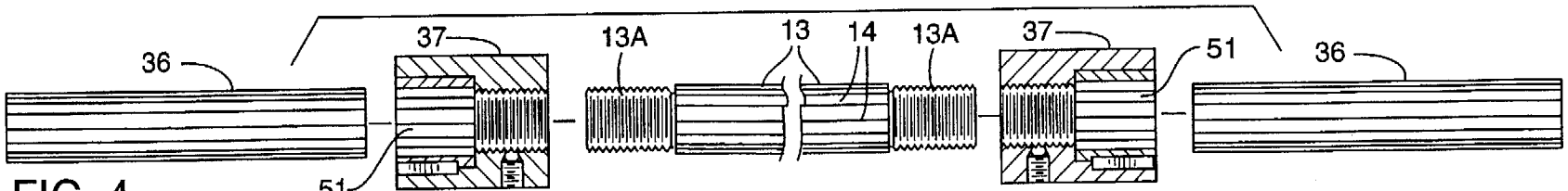
FIG. 4 is a segmented view of the nose bar shaft, connectors and drive members exploded therefrom.

Nose bar assembly 6 includes rolls 16 which have a grooved or fluted exterior surface to enhance driving engagement with block B. Suitable roll grooves may be 0.050 of an inch wide and uniformly closely spaced about the roll periphery. As shown in FIG. 3, each roll 16 of the nose bar assembly is fitted endwise with an internally splined insert 17 adjacent each roll end. Pins 18 lock the splined inserts in place within the roll against roll shoulders 19. The end located rolls, as shown in FIG. 3, have their splined inserts 17 offset from the outer ends of each end roll to permit installation of drive components, later described, in the rolls. Spacer elements 20 of each bearing assembly 7 transfer any axial loads from the rolls to the bearing assemblies. The rolls 16 are counterbored at 21 to minimize spacing between roll ends. A maximum wall thickness of ⅝ of an inch or so contributes along with splined shaft 13 toward nose bar rigidity.

Figure 5:
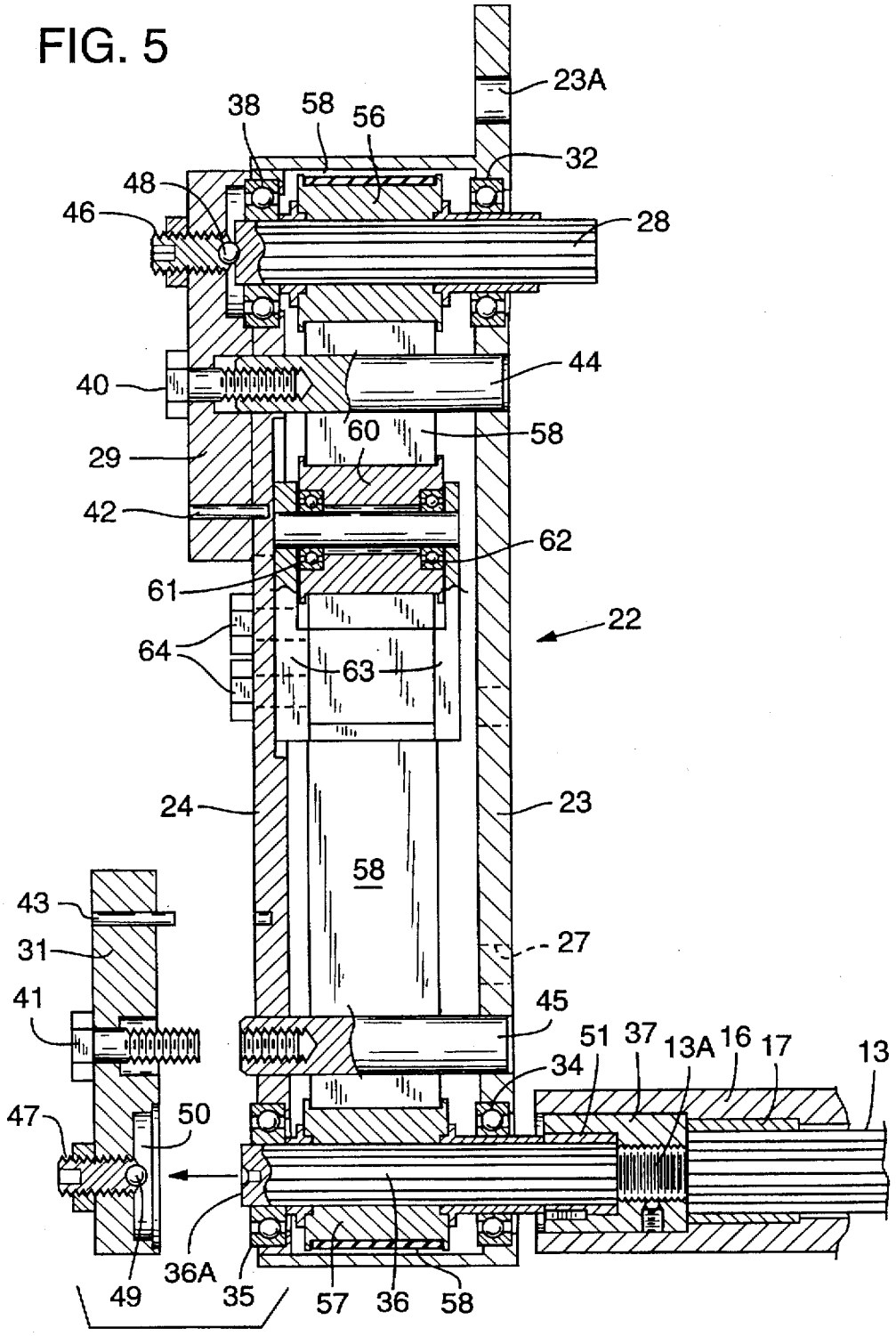
FIG. 5 is a sectional view taken along line 5—5 of FIG. 1 showing details of a power transmission unit of the present nose bar assembly.

A power transmission is shown generally at 22 in FIG. 1 and FIG. 5 with a second transmission unit (not shown) at a remaining end of the nose bar assembly being a mirror image of the unit shown. A transmission case at 23 includes a plate 24. The case is apertured at 23A to receive mounting fasteners 25 with some extending through a mounting bracket 26 in place on pressure bar 1 adjacent an end thereof. Additional openings 27 in the case receive fasteners for engagement with a pressure bar end wall. A power input shaft at 28 is suitable coupled to and driven by a motor 30 preferably of the hydraulic type controlled by a variable output pump. Closure caps 29 and 31, along with case 23, serve to carry sets of bearings 32–33 and 34–35 for splined input shaft 28 and a splined drive member 36 the latter terminating in removable axial engagement with a nose bar connector 37. Caps at 29 and 31 are each secured by a bolt 40 and 41 and posts 44–45 in friction fit with case 23. Provision is made for taking up any end play of the input shaft 28 and drive or output member 36 in the form of set screws 46–47 each having a thrust receiving ball element 48–49 which seats in a shaft end recess. With attention to output drive member 36, the same has an end segment 36A which projects outwardly past bearing 35 and into a recessed area 50 of cap 31. Upon backing off of the cap fastener 41 to the extent the cap may be rotated, shaft end 36A will be exposed for attachment of a shaft pulling tool for removal of drive member 36 from engagement with a splined insert 51 in a coupler 37 housed in an outermost roll 16 of the nose bar assembly. Insert 51 is pinned to the coupler. Disengagement of both drive members 36 from couplers 37 at both ends of the nose bar permits the nose bar assembly to be lifted laterally away from the pressure bar of the lathe upon unbolting of the bearing assemblies 7. The couplers 37 are in a friction fit with each end located roll 16.

Grooving of the nose bar assembly rolls is preferably done after assembly of the rolls in place on fully splined shaft 13 which results in all the roll grooves being aligned. It has been found that each groove alignment greatly reduces end loading of rolls 16 and hence wear of bearing assemblies 7. Further, utilization of splined components including fully splined shaft 13, inserts 17 and bearing races 12 contribute to bearing life and, more importantly, uniform pressure being applied to block B proximate the cut by blade 4. Accordingly variances in the thickness of the veneer being peeled from the block are held in experimental peeling efforts to ±0.003 of an inch.

Nose bar asembly removal from a veneer lathe has now been reduced to less than an hour in view of the present drive set up as opposed to prior art drive arrangements for nose bar assemblies requiring three to four hours for assembly removal from a lathe.

The power transmission generally at 22 further includes splined belt sprockets 56–57 on which is entrained a toothed belt 58. An idler sprocket 60 and bearings therefor at 61–62 are carried by an adjustable take up bracket 63. Bracket 63 is adjustable to vary belt tension by means of bolts 64 extending through an inclined slot in transmission plate 24.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. A nose bar and drive assembly for a wood veneer lathe, the invention comprising, a power source, power transmission units driven by said power source, a nose bar shaft having splines extending lengthwise therealong, a series of rolls in place along said shaft for biased contact with a wood surface, said rolls having internal splines for engagement with the splines on said shaft, couplers in place on the ends of said shaft, bearing assemblies at intervals along said shaft and in splined engagement with said shaft, and said power transmission units each including drive members each in respective inwardly inserted engagement with one of said couplers to drive said nose bar shaft, said power transmission units including retainers confining said drive members against axial displacement, said retainers positionable to permit axial extraction of said drive members to facilitate shaft and bearing assembly removal from the lathe.

2. The roller bar assembly claimed in claim 1 wherein said drive members have lengthwise extending splines.

3. The roller bar assembly claimed in claim 2 wherein said retainers each include a cap, adjustable means carried by said cap for preloading a drive member and said shaft in an axial direction.

4. The roller bar assembly claimed in claim 1 wherein said drive members include ends exposed upon positioning of said retainers enabling extraction of the drive members from their respective power transmission units.

5. A nose bar assembly for a veneer lathe and comprising, a nose bar shaft having lengthwise extending splines, a series of rolls on said shaft for biased contact with a wood article, said rolls having internally splined inserts for engagement with the shaft splines, bearing assemblies for mounting on the veneer lathe and located at intervals along said nose bar shaft and including splined bearing races for shaft reception, and said rolls having grooves along their peripheral surfaces with the grooves of each roll in alignment with the grooves of an adjacent roll to reduce thrust loads imparted to the nose bar shaft.

6. The nose bar assembly claimed in claim 5 additionally including a coupler at each end of said shaft, each coupler having internal splines for inserted reception of a drive member.

7. A nose bar and drive assembly for a veneer lathe and comprising, a nose bar shaft having lengthwise extending splines, rolls in place on said shaft for biased contact with a wood article supported in the veneer lathe, bearing assemblies located at intervals along the nose bar shaft and including splined bearing races for reception of the nose bar shaft splines, said rolls including outermost rolls each adjacent an end of the nose bar shaft and including a coupler, a power transmission on said lathe and including a drive member in axial engagement with said coupler, cap means confining said drive member in engagement with said coupler, fastener means mounting said cap means in a manner permitting access to said drive member for disengagement of the drive member from said coupler facilitating nose bar shaft and bearing assembly removal from the veneer lathe.

* * * * *